US006412538B1

(12) United States Patent
Welfonder

(10) Patent No.: US 6,412,538 B1
(45) **Date of Patent: *Jul. 2, 2002**

(54) SIDE GUIDE FOR A ROLLER COVERING

(76) Inventor: Konrad Welfonder, Loisachstrasse 23, 27574 Bremerhaven (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/549,300

(22) Filed: Apr. 14, 2000

(30) Foreign Application Priority Data

Apr. 14, 1999 (EP) ..... 99201122

(51) Int. Cl.[7] ..... A47H 3/00
(52) U.S. Cl. ..... 160/271; 160/371; 160/380
(58) Field of Search ..... 160/266, 268.1, 160/270, 271, 371, 380, 381, 395

(56) References Cited

U.S. PATENT DOCUMENTS

| | | | | |
|---|---|---|---|---|
| 3,220,469 A | * | 11/1965 | Oehmig | 160/380 |
| 3,552,476 A | * | 1/1971 | Le Tarte | 160/371 |
| 4,357,978 A | | 11/1982 | Keller et al. | |
| 4,458,739 A | | 7/1984 | Murray et al. | |
| 4,544,012 A | * | 10/1985 | Woodward | 160/90 |
| 4,665,670 A | * | 5/1987 | Van Den Burg | 160/380 X |
| 4,894,960 A | * | 1/1990 | Hill et al. | 52/28 |
| 4,932,453 A | * | 6/1990 | Hoover et al. | 160/90 |
| 4,967,424 A | * | 11/1990 | Stegmeier | 160/395 X |
| 6,125,910 A | * | 10/2000 | Pepperell et al. | 160/371 |

FOREIGN PATENT DOCUMENTS

| | | |
|---|---|---|
| DE | 9301944 | 6/1994 |
| DE | 4406267 | 11/1997 |
| DE | 19823853 | 11/1998 |
| EP | 841461 | 5/1998 |
| GB | 2235005 | 11/1993 |

* cited by examiner

*Primary Examiner*—Bruce A. Lev
(74) *Attorney, Agent, or Firm*—Dorsey & Whitney LLP

(57) ABSTRACT

A side guide for an architectural roller covering includes a base (18) and a cover (20). The base has a longitudinally-extending base web (22) with an outer flange (24) and an inner flange (34) extending laterally from a lateral surface of the base web. A free lateral end of the outer flange (24) has a first hinge formation (32) that is longitudinally directed towards the inner flange (34). The cover has a longitudinally-extending cover web (42) with a second hinge formation (48) and a bent arm (50) extending laterally from a lateral surface of the cover web (42) towards the base (18). The lateral surface of the base web (22) faces the lateral surface of the cover web (42), the second hinge formation (48) being located longitudinally between the base inner and outer flanges (34,24) and extending longitudinally towards the first hinge formation (32) and away from the bent arm (50). The bent arm is located longitudinally between the inner and outer flanges (34,24) and has an elbow (55) that extends towards the second hinge formation (48) and is between two laterally-extending portions (52,54) of the bent arm. The first and second hinge formations cooperate, and the cover pivots about them to move the bent arm (50) laterally towards the base web (22) until a free lateral end of the bent arm contacts the lateral surface of the base web and a laterally-extending surface of the inner flange (34) to resiliently lock the cover (20) on the base (18).

19 Claims, 1 Drawing Sheet

SIDE GUIDE FOR A ROLLER COVERING

CROSS-REFERENCE TO RELATED APPLICATION

This application corresponds to and claims priority to European Application No. 99201122.1, filed Apr. 14, 1999. This European application is hereby incorporated by reference as though fully set forth herein.

BACKGROUND OF THE INVENTION a. Field of the Invention

This invention relates to a side guide for enclosing the sides of an architectural roller covering, especially a roller covering for an architectural opening, such as a roller screen, shade, or blind for a window.

b. Description of the Related Art

Side guides for architectural roller coverings are known, for example, from the following patent publications: EP 0 841 461, DE 44 06 267, U.S. Pat. No. 4,357,978 and GB 2 235 005. Typically, such side guides include generally U-shaped, vertically-extending channels. The channels preferably surround the front and back of the sides of the roller coverings, adjacent their side edges, to prevent heat, dirt, and insects from getting past their side edges and/or to keep the coverings in a vertical plane while allowing them to move vertically unhindered when raising and lowering them. Such side guides have also typically been adapted to be removably fit onto mounting members on a wall, adjacent to a window which such roller coverings are intended to cover.

SUMMARY OF THE INVENTION

The installation and maintenance of such side guides has generally not been easy. In this regard, side guides have been sought which are easier to disassemble and reassemble when cleaning or installing their roller coverings.

This invention provides a side guide for an architectural roller covering, such as a roller screens shade, or blind for a window, having:

a base having a longitudinally-extending elongated base web with an outer flange and an inner flange extending laterally from a lateral surface of the base web; a free lateral end of the outer flange having a first hinge formation that is longitudinally directed towards the inner flange; and a cover having a longitudinally-extending elongated cover web with a second hinge formation and a bent arm extending laterally from a lateral surface of the cover web towards the base; the lateral surface of the base web facing the lateral surface of the cover web; the second hinge formation being located longitudinally between the inner and outer flanges of the base and extending longitudinally towards the first hinge formation and away from the bent arm; and the bent arm also being located longitudinally between the inner and outer flanges of the base and having an elbow that extends towards the second hinge formation and is between two laterally-extending portions of the bent arm;

whereby the second hinge formation can cooperate with the first hinge formation and the cover can be pivoted about the cooperating first and second hinge formations to move the bent arm laterally towards the base web until a free lateral end of the bent arm contacts the lateral surface of the base web and a laterally-extending surface of the inner flange, facing the outer flange, to resiliently lock the cover on the base.

Advantageously, the base and cover extend vertically and preferably are coextensive. It is especially advantageous that a first portion of the bent arm, at a lateral end of the elbow remote from the cover web, extends i) longitudinally away from the second hinge formation, ii) laterally away from the cover web at an acute angle to the cover web, and iii) towards the laterally-extending surface of the inner flange. It is particularly advantageous that a second portion of the bent arm, connected to the cover web and the elbow, extends laterally away from the cover web and longitudinally towards the second hinge formation. It is also particularly advantageous that the first hinge formation be a hinge groove that is longitudinally open towards the inner flange and that the second hinge formation be a hook. It is further particularly advantageous that the free lateral end of the bent arm is lockingly accommodated adjacent the laterally-extending surface of the inner flange when the free lateral end contacts the lateral surface of the base web.

In accordance with another aspect of the invention, an architectural roller covering, such as a roller screen, shade, or blind for a window, is provided, which includes a side guide of this invention.

DETAILED DESCRIPTION OF THE PREFERRED EMBODIMENTS

Further aspects of the invention will be apparent from the detailed description below of a particular embodiment.

Figure 1:
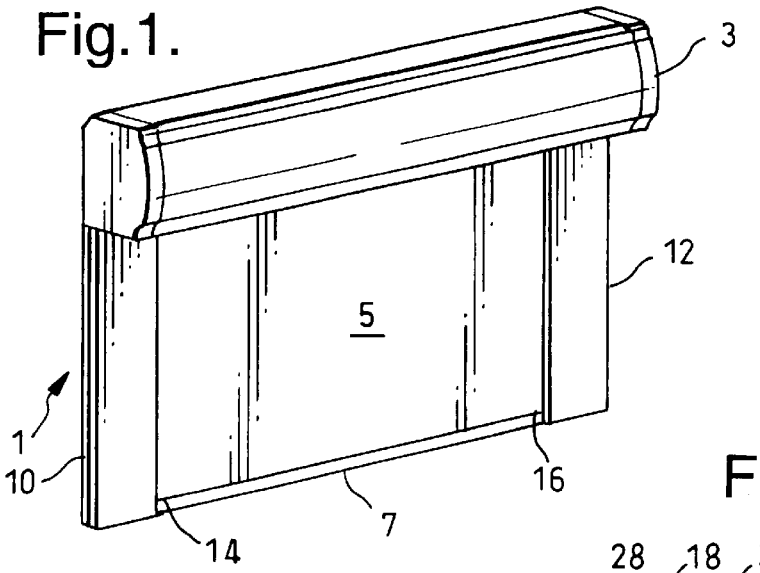
FIG. 1 is a perspective view of a roller blind, showing a pair of assembled side guides of the invention along opposite lateral sides of the blind.

FIG. 1 shows a roller blind, generally 1, for a window (not shown). The blind 1 has a conventional longitudinally-extending elongated head rail 3 that contains a conventional longitudinally-extending elongated roller (not shown) connected to the top of a conventional flexible covering member 5. The bottom of the covering member 5 is attached to a conventional longitudinally-extending bottom rail 7. The covering member 5 is adapted to be extended and subsequently retracted by being wound about the roller in the head rail 3. In this regard, the head rail 3 can include conventional mechanisms for extending and automatically retracting the covering member.

The roller blind 1 also has a pair of vertically-extending, left and right, side guides, generally 10 and 12. respectively, of this invention on opposite longitudinal sides. As described below with reference to FIGS. 2–4, the left and right side guides 10, 12 are adapted to be mounted on a wall (not shown), adjacent to the window, and to be subsequently removed, for example, for cleaning behind the roller blind 1. The side guides 10, 12 surround the left and right sides 14 and 16, respectively, of the covering member 5, adjacent its side edges. Thereby, the side guides 10, 12 close off the side edges of the covering member 5 to the passage of heat, dirt, and insects while not hindering the covering member 5 from moving vertically when being raised and lowered. The left and right side guides 10, 12 are preferably the same and are mounted in FIG. 1 as mirror images on a wall and on longitudinally opposite sides of the covering member 5. The side guides 10, 12 are also preferably made of plastic.

Figure 2:
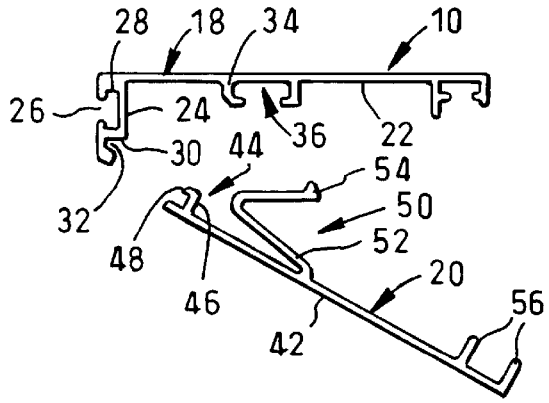
FIG. 2 is a top plan view of one of the side guides of FIG. 1, before it is assembled.

FIG. 2 shows the left side guide 10 of the blind 1 of FIG. 1 before it has been assembled to receive the left side 14 of the covering member 5. The left side guide 10 has a vertically-extending base, generally 18, and a vertically-extending cover, generally 20, in front of the base 18.

The base 18 of the left side guide 10, as shown in FIG. 2, has a longitudinally- and vertically-extending, elongated base web 22. Preferably extending laterally through the base web 22 of the left side guide 10 are vertically spaced apertures (not shown) which can be used for affixing the base 18 to a longitudinally-extending wall adjacent to a window in a conventional manner (e.g., with nails or screws).

Attached to the left end of the front surface of the base web 22 of the left side guide 10 is a vertically-extending outer flange 24, extending also frontally towards the cover 20. The outer flange 24 preferably has a conventional under-cut longitudinally-extending mounting groove 26 at its rear end, adjacent the base web 22. The groove 26 is formed by a pair of longitudinally-extending, rear and front ribs 28,30 that are integral with the outer flange 24. The groove 26 is open to the left, away from the right side guide 12 and can be used for affixing the outer flange 24 and the base 18 to a laterally-extending wall, adjacent to a window (for example, by inserting the vertically-aligned heads of nails or screws, projecting to the right from the wall, into the groove 26). The groove 26 can also be used to hold other elements, such as brackets or sealing strips, inserted into it.

The front end of the outer flange 24 of the left side guide 10 also has a first hinge formation in the form of a hinge groove 32. The hinge groove 32 is open towards the right side guide 12.

Also attached to the front surface of the base web 22 of the left side guide 10 is a vertically-extending first inner flange 34, that also extends frontally towards the cover 20 and is spaced to the right of the outer flange 24. The first inner flange 34 preferably forms the left side of a conventional under-cut first frontally-open mounting groove 36 on the front of the base web 22. The groove 36 can hold a conventional, frontally-extending brush or sealing strip (not shown) that is inserted in the groove 36 and can contact the rear of the left side 14 of the covering member 5 to close it off to the passage of heat, dirt, and insects.

Also preferably attached to the front surface of the base web 22 of the left side guide 10 is a vertically-extending second inner flange 38, that also extends frontally towards the cover 20 and is spaced to the right of the first frontally-open mounting groove 36. The second inner flange 38 preferably forms one longitudinal side of a conventional under-cut second frontally-open mounting groove 40, spaced to the right of the first frontally-open mounting groove 36. The second laterally-open mounting groove 40 can also be used for holding a conventional, frontally-extending brush or other sealing member (not shown) which is inserted in the groove 40 and can contact the rear of the left side 14 of the covering member 5 to further close it off to the passage of heat, dirt, and insects.

The cover 20 of the left side guide 10, as shown in FIG. 2, has a longitudinally- and vertically-extending, elongated cover web 42. Attached to the rear surface of the cover web 42 is a vertically-extending second hinge formation in the form of a hook member, generally 44. The hook member 44 is located between the outer flange 24 and the first inner flange 34 of the base 18 and extends rearwardly towards the outer flange 24. In this regard, the hook member 44 has a rearwardly-extending stem 46, attached to the cover web 42, a short distance to the right of its left end, and a hook 48 that is on the rear end of the stem 46. The hook 48 extends away from the right side guide 12, towards the hinge groove 32 on the outer flange 24 on the front of the base 18.

Figure 3:
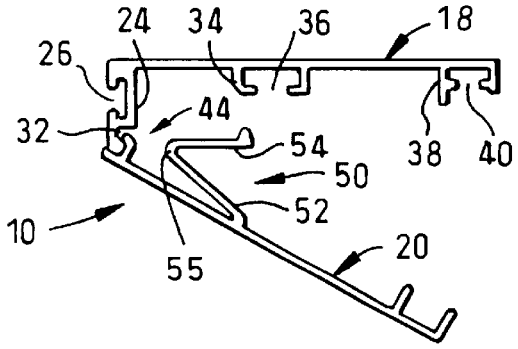
FIG. 3 is a top plan view, similar to FIG. 2, of one of the side guides of FIG. 1 after it has been partially assembled.
Figure 4:
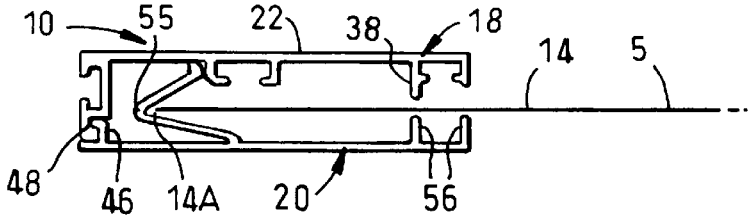
FIG. 4 is a top plan view, similar to FIG. 3, of one of the side guides of FIG. 1 after it has been fully assembled and surrounds one side of a flexible covering member of the blind, adjacent the side edge.

Also attached to the rear surface of the cover web 42 of the left side guide 10 is a vertically-extending bent arm, generally 50. The bent arm 50 is also located between the outer flange 24 and the first inner flange 34 of the base 18 and extends rearwardly towards the first inner flange 34. In this regard, the bent arm 50 includes a front portion 52 that is spaced to the right of the stem 46 of the hook member 44 and extends rearwardly and to the left from its attachment to the rear surface of the cover web 42, towards the hook 48. The bent arm 50 also includes a rear portion 54, that is connected by an elbow 55 to the front portion 52 and that extends rearwardly and to the right from the elbow 55, away from the hook 48. The elbow 55 extends towards the hook member 44 and forms an acute angle to the right as shown in FIGS. 2–4. As a result, the rear portion 54 of the bent arm 50 has its free rear end remote from the cover web 42 and extends i) to the right, away from the hook 48; ii) rearwardly at an acute angle to the right relative to the rear surface of the cover web 42; and iii) towards a frontally-extending left surface of the inner flange 34, facing the outer flange 24 when viewed from the top of the left side guide 10 as in FIGS. 2–4. Preferably, the front and rear portions 52, 54 of the bent arm 50 are substantially straight.

The elbow 55 between the front and rear portions 52, 54 of the bent arm 50 is adapted to accommodate a significant longitudinal length of the left side 14 of the covering member 5 within the left side guide 10 as shown in FIG. 4. The elbow 55 is also adapted to promote the resilient flexing of the rear portion 54 frontally, relative to the front portion 52. However, it is believed that specific acute angles for the elbow 55 are not critical to the side guides 10, 12 of this invention or their operation.

Also preferably attached to the rear surface of the cover web 42 of the left side guide 10 are a pair of vertically-extending third inner flanges 56, that also extend rearwardly toward the base 18 and are spaced to the right of the bent arm 50. The rear ends of the third inner flanges 56 serve, together with the front end of the second inner flange 38, to retain and guide the left side 14 of the covering member 5, so that it extends longitudinally and vertically within the left side guide 10 as shown in FIG. 4.

The cover 20 can be attached to the base 18 to form the vertically-extending left side guide 10 for the left side 14 of the covering member 5 of the roller blind 1, between its head rail 3 and bottom rail 7 as described below with reference to FIGS. 2–4.

The vertically-extending base 18 of the left side guide 10 can be mounted initially on a wall, to the left of, and adjacent to, a window in a conventional manner, using nails or screws engaging the vertically aligned apertures (not shown) in the base web 22 or the longitudinally-extending mounting groove 26. As shown in FIG. 4, the base 18 will extend longitudinally behind the left side edge 14A of the covering member 5 of the blind 1, mounted in front of the window. The outer flange 24 of the base 18 will be located to the left oft he left side edge 14A oft he covering member 5 and to the left of its inner flange 34. If desired, frontally-extending elongated brushes or sealing members (not shown) can be inserted in the frontally-open mounting grooves 36, 40.

The vertically-extending cover 20 can then be positioned in front of, and at an acute angle to, the base 18. The hook member 44 of the cover 20 extends rearwardly, with its hook 48 to the right of and in front of the hinge groove 32 on the front end of the outer flange 24 of the base 18.

The cover web 42 and the hook member 44 of the cover 20 can then be moved rearwardly and to the left, so that the hook 48 engages the hinge groove 32 of the base 18 as shown in FIG. 3.

Then, the cover web 42 of the cover 20 can be pivoted rearwardly about the hinged connection of its hook 48 to the hinge groove 32 of the base 18 to move the bent arm 50 rearwardly towards the base web 22. The bent arm 50 of the cover 20 is moved rearwardly until the free rear end of its rear portion 54 contacts the front surface of the base web 22. The cover web 42 of the cover 20 will then extend longitudinally, with the free rear end of its rear arm portion 54 also contacting, and being resiliently urged against, the left side of the first inner flange 34 of the base 18, so as to keep the left side guide 10 securely closed as shown in FIG. 4. In this regard, the rear arm portion 54 preferably extends sufficiently far to the right, away from the hook 48, so that the left side of the first inner flange 34 is in continuous contact with the free rear end of the rear arm portion 54 and urges it to the left, thereby resiliently flexing the bent arm 50 to the left and resiliently flexing its rear portion 54 frontally relative to its front portion 52 as the cover 20 is pivoted rearwardly. Such resilient flexing continues until the rearwardly moving, free rear end of the rear arm portion 54 contacts the front surface of the base web 22 and preferably is lockingly accommodated to the left of, and adjacent to, the left side of the inner flange 34, so as to resiliently lock the cover 20 on the base 18.

The right side guide 12, which is a mirror image of the left side guide 10, can then be assembled in the same way.

Lastly, the sides 14, 16 of the covering member 5 can be inserted between the base 18 and the cover 20 of the left and right side guides 10, 12. As shown in FIG. 4, the left side edge 14A of the covering member will be to the right of, and adjacent to, the elbow 55 connecting the front and rear portions 52, 54 of the bent arm 50 of the left side guide 10 and within the acute angle of the elbow. The corresponding right side edge (not shown) of the covering member 5 within the right side guide 12 will be the mirror image of what is shown in FIG. 4.

This invention is, of course, not limited to the above-described embodiment which can be modified without departing from the scope of the invention or sacrificing all of its advantages. In this regard, the terms in the foregoing description and the following claims, such as "right", "left", "front", "rear", "upward", "downward", "longitudinal", "lateral", "height", "vertical", "bottom", and "top", have been used only as relative terms to describe the relationships of the various elements of the side guide of the invention for a retractable architectural covering. For example, the cover 20 could be provided with a plurality of vertically aligned apertures or a conventional under-cut longitudinally-extending mounting groove for mounting the cover on a wall, adjacent a window to be covered by the roller blind 1, and the base 18 could be hingedly connected to, and in front of, the cover to form the side guides 10, 12. Likewise, the hinge groove 32 could be provided on the stem 46 of the cover 20 and the hook member 44 could be provided on the outer flange 24 of the base 18, provided its hook 48 extends towards the hinge groove.

I claim:

1. A side guide for an architectural roller covering, said side guide comprising:

a base having a longitudinally-extending base web with an outer flange and an inner flange extending laterally from a lateral surface of the base web said inner flange being spaced from said outer flange along an uninterrupted segment of said lateral surface; a free lateral end of the outer flange having a first hinge formation that is longitudinally directed towards the inner flange; and a cover having a longitudinally-extending cover web with a second hinge formation and a resilient bent arm extending laterally from a lateral surface of the cover web towards the base; the lateral surface of the base web facing the lateral surface of the cover web; the second hinge formation extending longitudinally towards and being in contact with the first hinge formation; and the bent arm being located longitudinally between the inner and outer flanges and having an elbow that extends towards the second hinge formation and is between two laterally-extending portions of the bent arm, one of the two laterally-extending portions of the bent arm having a free end, the bent arm being in a continuously yielding engagement through the free end with both the lateral surface of the base web and a laterally-extending surface of the inner flange, facing the outer flange;

wherein a biasing force is supplied by resilient deformation of the bent arm relative to the cover to hold (i) the first hinge formation in contact with the second hinge formation and (ii) the free end in simultaneous contact with the lateral surface of the base web and the laterally extending surface of the inner flange.

2. The guide of claim 1 wherein the base member and the cover member extend vertically.

3. The side guide of claim 1 wherein the base member and the cover member are coextensive.

4. The side guide of claim 1 wherein a first portion of the bent arm, at a lateral end of the elbow remote from the cover web, extends i) longitudinally away from the second hinge formation, ii) laterally away from the cover web at an acute angle to the cover web, and iii) towards the laterally-extending surface of the inner flange.

5. The side guide of claim 1 wherein a second portion of the bent arm, connected to the cover web and the elbow, extends laterally away from the cover web and longitudinally towards the second hinge formation.

6. The side guide of claim 5 wherein the first and second portions of the bent arm are substantially straight.

7. The side guide of claim 1 wherein the first hinge formation is a hinge groove that is longitudinally open towards the inner flange and the second hinge formation is a hook.

8. The side guide of claim 1 wherein the free lateral end of the bent arm is lockingly accommodated adjacent the laterally-extending surface of the inner flange when the free lateral end contacts the lateral surface of the base web.

9. The side guide of claim 1, further comprising a slot formed between the lateral surfaces of the base web and cover web, the slot adapted to receive a side edge of a covering member of the roller covering, the slot permitting vertical movement of the side edge therein.

10. An architectural roller covering, said roller covering comprising:

a side guide, said side guide comprising:

a base having a longitudinally-extending base web with an outer flange and an inner flange extending laterally from a lateral surface of the base web said inner flange being spaced from said outer flange along an uninterrupted segment of said lateral surface; a free lateral end of the outer flange having a first hinge formation that is longitudinally directed towards the inner flange; and a cover having a longitudinally-extending cover web with a second hinge formation and a resilient bent arm extending laterally from a lateral surface of the cover web towards the base; the lateral surface of the base web facing the lateral surface of the cover web; the second hinge formation extending longitudinally towards and being in contact with the first hinge formation; and the bent arm being located longitudinally between the inner and outer flanges and having an elbow that extends towards the second hinge formation and is between two laterally-extending portions of the bent arm, one of the two laterally-extending portions of the bent arm having a free end, the bent arm being in a continuously yielding engagement through the free end with both the lateral surface of the base web and a laterally-extending surface of the inner flange, facing the outer flange;

wherein a biasing force is supplied by resilient deformation of the bent arm relative to the cover to hold (i) the first hinge formation in contact with the second hinge formation and (ii) the free end in simultaneous contact with the lateral surface of the base web and the laterally extending surface of the inner flange.

11. The architectural roller covering of claim 10 wherein the base member and the cover member extend vertically.

12. The architectural roller covering of claim 10 wherein the base member and the cover member are coextensive.

13. The architectural roller covering of claim 10 wherein a first portion of the bent arm, at a lateral end of the elbow remote from the cover web, extends: i) longitudinally away from the second hinge formation, ii) laterally away from the cover web at an acute angle to the cover web, and iii) towards the laterally-extending surface of the inner flange.

14. The architectural roller covering of claim 10 wherein a second portion of the bent arm, connected to the cover web and the elbow, extends laterally away from the cover web and longitudinally towards the second hinge formation.

15. The architectural roller covering of claim 14 wherein the first and second portions of the bent arm are substantially straight.

16. The architectural roller covering of claim 10 wherein the first hinge formation is a hinge groove that is longitudinally open towards the inner flange and the second hinge formation is a hook.

17. The architectural roller covering of claim 10 wherein the free lateral end of the bent arm is lockingly accommodated adjacent the laterally-extending surface of the inner flange when the free lateral end contacts the lateral surface of the base web.

18. The roller covering of claim 10, further comprising a covering member with at least one side edge, and wherein the side guide further comprises a slot formed between the lateral surfaces of the base web and cover web, the slot having the at least one side edge received therein and permitting vertical movement of covering member.

19. A side guide for an architectural roller covering, the side guide comprising:

a base having a longitudinally extending base web, the base web having front surface with an outer flange and an inner flange extending laterally from the front surface, the outer flange having a first hinge formation, the first hinge formation comprising either a groove or a hook, the hook being adapted to receive the hook, the inner flange including a laterally extending surface, the laterally extending surface facing towards the outer flange; and a cover having a longitudinally extending cover web, the cover web having a rear surface with a second hinge formation and a bent arm member extending laterally therefrom towards the front surface, the second hinge formation comprising the other of the hook or groove, the first and second hinge formations being in operative connection with each other, the bent arm comprising a first arm portion, an elbow portion, a second arm portion and a free end portion, the first arm portion being connected to the rear surface at one end and the elbow portion at another end, the second arm portion also being connected to the elbow portion at one end and terminating at the free end portion, the bent arm being resiliently deformed with the free end portion biased against and in simultaneous connection with both the front surface and the laterally extending surface.

* * * * *